US005093190A

United States Patent [19]

Kwok et al.

[11] Patent Number: 5,093,190

[45] Date of Patent: Mar. 3, 1992

[54] SPUNLACED ACRYLIC/POLYESTER FABRICS

[75] Inventors: Wo K. Kwok, Hockessin, Del.; James R. Vincent, Old Hickory, Tenn.

[73] Assignee: E. I. Du Pont de Nemours and Company, Wilmington, Del.

[21] Appl. No.: 601,832

[22] Filed: Oct. 22, 1990

[51] Int. Cl.[5] ..... A47L 13/16; A61F 13/20; D04H 1/46

[52] U.S. Cl. ..... 428/288; 15/209 R; 28/105; 428/297; 604/378; 604/383

[58] Field of Search ..... 15/209 R; 28/105; 428/288, 297; 604/378, 383

[56] References Cited

U.S. PATENT DOCUMENTS 3,403,862 10/1968 Dworjanyn ..... 239/566
3,485,706 12/1969 Evans .
3,485,709 12/1969 Evans et al. .
3,797,074 3/1974 ZaFiroglu ..... 19/156.3
4,442,161 4/1984 Kirayoglu et al. ..... 28/105
4,693,922 9/1987 Buyofsky et al. ..... 28/105

OTHER PUBLICATIONS

Kwok et al., "Characterization of Cleanroom Wipers: Particle Generation" 1990 Proceeding-Inst. Environmental Sciences, pp. 365-372 (1990).

"Wipers Used in Clean Rooms and Controlled Environments", Recommended Practice-Inst. Environmental Sciences, IEP-RP-CC-004-87-T, pp. 1-13 (10/87).

*Primary Examiner*—James C. Cannon

[57] ABSTRACT

A process is disclosed for making spunlaced acrylic/-polyester fabrics comprising applying low impact water jet energy to a fabric web and vacuum dewatering the resulting spunlaced fabric. The spunlaced fabrics exhibit very low wet and dry particle counts and high absorbency thereby making them particularly useful in cleanroom wiper applications and as coverstock for sanitary napkins, diapers and the like.

9 Claims, 2 Drawing Sheets

SPUNLACED ACRYLIC/POLYESTER FABRICS

FIELD OF THE INVENTION

The present invention relates to a process for making spunlaced acrylic/polyester fabrics. More particularly, the invention relates to a process for making spunlaced acrylic/polyester fabrics by applying low impact water jet energy and vacuum dewatering such that the fabrics produced exhibit very low wet and dry particle counts and high absorbency.

BACKGROUND OF THE INVENTION

Fabric wipers used in clean room applications require low particle generation when flexed in air and when washed in water. In addition, the wipers must exhibit a high absorbency rate and capacity. However, particle and absorbency properties for many fabrics are many times mutually exclusive of each other. For example, 100% polyester fabrics generate low particle counts but provide almost no absorbency. On the other hand, cotton fabrics exhibit high absorbency rates and capacity but generate unacceptably high particle counts.

Commercially available spunlaced woodpulp/polyester (55%/45%) fabrics have proved adequate in Class 100 cleanroom environments (i.e., no more than 100 particles/$ft^3$ air). Although this fabric may be acceptable in Class 100 environments, it is not acceptable in Class 10 environments. Class 10 environments (i.e., no more than 10 particles/$ft^3$ air) are more desirable for sensitive clean room applications.

Example III of U.S. Pat. No. 3,485,709 (Evans) discloses hydroentangling an acrylic/polyester web to produce a spunlaced fabric. The fabric is made using a laboratory table washer. The hydroentanglement process calls for imparting high energy water jets to the web to entangle the web and produce a spunlaced fabric. In FIG. 40 of a related patent (U.S. Pat. No. 3,485,706 (Evans)), a continuous commercial process is disclosed wherein the fabric is subsequently dewatered by one or more squeeze rollers. Unfortunately, the application of high impact energy and squeeze roll dewatering generates particle counts which are unacceptable for sensitive cleanroom wiper applications.

Clearly, what is needed is a fabric which provides an adequate degree of absorbency but a low wet and dry particle count. In this regard, the applicants have found that spunlaced fabrics made of acrylic/polyester blends provide both low particle generation and good absorbency when processed under certain critical conditions. Specifically, the applicants have found that low water jet energy must be applied to the acrylic/polyester web in order to achieve an adequate balance of low wet and dry particle counts and good absorbency. Other objects and advantages of the present invention will become apparent to those skilled in the art upon reference to the attached drawings and to the detailed description of the invention which hereinafter follows.

SUMMARY OF THE INVENTION

In accordance with the invention, there is provided a process for making spunlaced acrylic/polyester fabrics having low wet and dry particle counts and good absorbency. The process comprises supporting a fabric web comprising 10–90 wt.% acrylic fibers and 10–90 wt.% polyester fibers on a mesh screen and passing the supported web underneath low energy water jets providing a total impact energy of no greater than 30 Hp-hr-$lb_f/lb_m$ to entangle the web and produce a spunlaced fabric. Preferably, the web is then passed through a vacuum dewaterer to help remove particles that may be suspended in the water after jetting. Spunlaced fabrics made by the inventive process are useful as cleanroom wipers and coverstock for sanitary napkins, diapers and the like.

In a preferred embodiment, the process comprises supporting a fabric web comprising 30–90 wt.% acrylic fibers and 10–70 wt.% polyester fibers on a mesh screen and passing the supported web underneath low energy water jets providing a total impact energy of between 5 to 28 Hp-hr-$lb_f/lb_m$ to entangle the web and produce a spunlaced fabric. Thereafter, the spunlaced fabric is vacuum dewatered to remove water and suspended particles.

The invention also provides for a spunlaced acrylic/-polyester fabric having a dry particle count no greater than 5000, a wet particle count no greater than 9500, an absorbency rate of at least 0.1 gm/gm/sec and an absorbency capacity of at least 600%. Most preferably, the spunlaced acrylic/polyester fabric has a dry particle count no greater than 1000, a wet particle count no greater than 8000, an absorbency rate of at least 0.25 gm/gm/sec and an absorbency capacity of at least 700%.

As used herein, "total impact energy" means the cummulative amount of energy that is provided to both sides of the fabric web. Preferably, each side of the fabric web is provided with about the same amount of impact energy although this is not critical to the invention.

BRIEF DESCRIPTION OF THE DRAWINGS

The invention will be better understood with reference to the following figures.

DETAILED DESCRIPTION OF THE PREFERRED EMBODIMENTS

Figure 1:
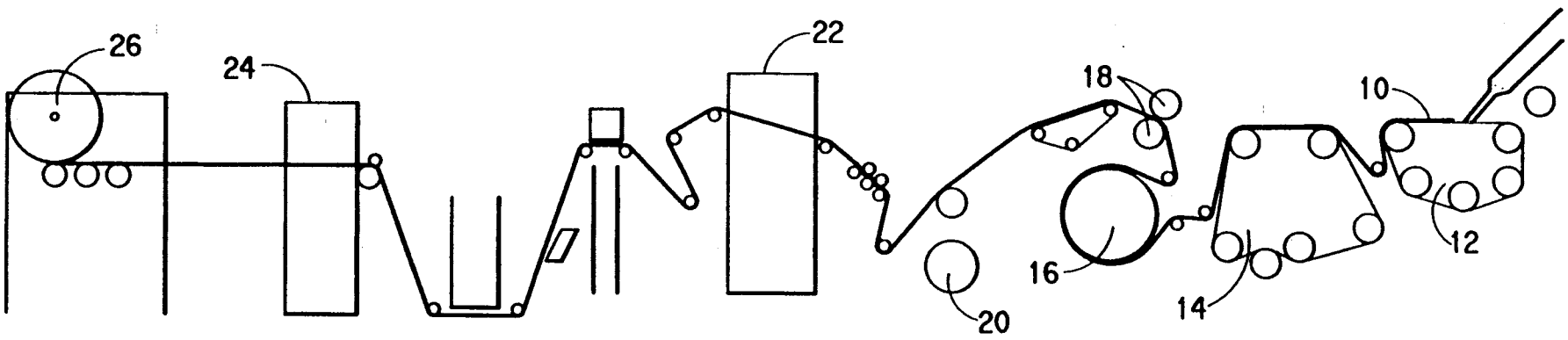
FIG. 1 is a schematic view of a continuous hydroentanglement process depicting belt and drum washers for water jetting both sides of a fabric web and a conventional squeeze roll for dewatering following water jetting.

Referring now to the figures, wherein like reference numerals represent like elements, schematic representations are shown of a continuous process of the prior art and a continuous process of the preferred invention. FIG. 1 depicts a prior art continuous process wherein a web of fibers 10 is air-laid onto a conveyor 12 having a mesh screen and conveyed towards a belt washer 14. Belt washer 14 contains a series of banks of water jets which treat one side of the fiber web. Thereafter, the web is passed underneath a series of banks of water jets while it is supported on a drum washer screen 16 so that the other side of the web can be treated. The resulting spunlaced fabric is passed through a squeeze roll 18 to dewater the fabric. Finally, the spunlaced fabric maybe further treated by a padder 20, a dryer 22 and a slitter 24 before it is wound up on roll 26.

Figure 2:
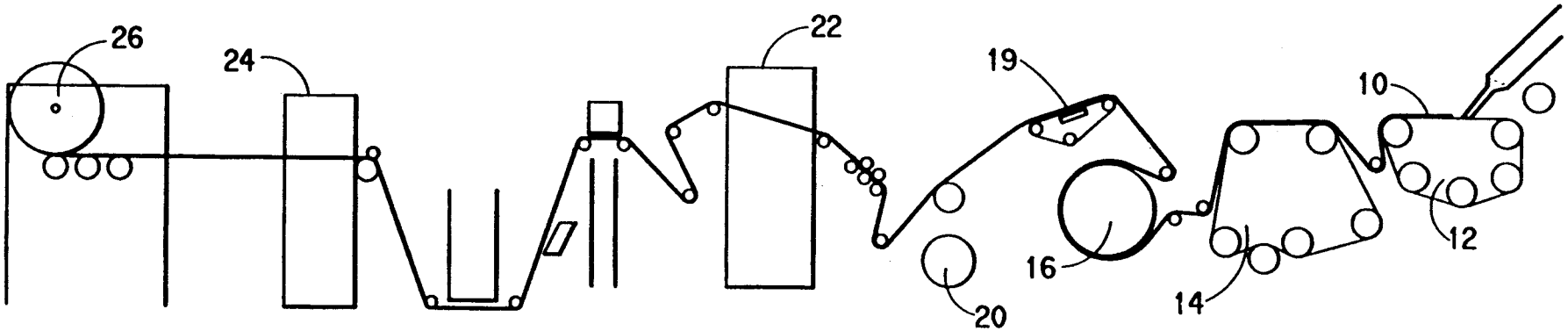
FIG. 2 is a schematic view of a preferred continuous hydroentanglement process of the invention depicting belt and drum washers for water jetting both sides of a fabric web and a vacuum dewatering extractor for removing water and suspended particles following water jetting.

FIG. 2 is identical to FIG. 1 except that the squeeze roll 18 has been replaced by a vacuum dewatering extractor 19. The vacuum extractor removes suspended particles that may have been dislodged during water jetting or have been transferred through the water or air thereby reducing the number of particles present in the spunlaced fabric. The vacuum extractor is positioned between the drum washer screen 16 and the dryer 22.

Although the process of hydrolacing an acrylic/-polyester fabric is not new, the fabrics formed by water jetting at conditions not disclosed by the prior art display physical properties and product features that are significantly different. These specific differences are set forth in the Tables below for fabrics of the invention and for fabrics of the prior art.

The following test procedures were employed to determine the various characteristics and properties reported below.

Dry particle count and wet particle count were determined by the test methods described in Kwok et al., "Characterization of Cleanroom Wipers: Particle Generation" *Proceedings-Institute of Environmental Sciences*, pp. 365-372 (1990) and "Wipers Used In Clean Rooms And Controlled Environments", *Institute of Environmental Sciences*, IES-RP-CC-004-87-T, pp. 1-13 (October, 1987). In brief, the spunlaced fabric is flexed in air on a Gelbo Flexer and the particles generated are measured with a laser counter as dry particle count. The wet particle count (i.e., number of particles suspended in water) is also measured with a laser counter after the fabric has been washed in water by the biaxial shake test method.

In the inventive process, the acrylic/polyester webs are subjected to low energy, low impact jets of water delivered through closely-spaced small orifices. The jets impart to the web a total impact-energy product ("I×E") of less than 30 Horsepower-hour-pounds force/pounds mass (Hp-hr-$lb_f/lb_m$).

Equipment of the general type described above, and mentioned in U.S. Pat. No. 3,485,709 (Evans) and U.S. Pat. No. 3,403,862 (Dworjanyn), is suitable for the water-jet treatment.

The energy-impact product delivered by the water jets impinging upon the fabric web is calculated from the following expressions, in which all units are listed in the "English" units in which the measurements reported herein were originally made so that the "I×E" product was in horsepower-hour-pounds force per pound mass.

$$I=PA$$

$$E=PQ/wzs$$

wherein:

I is impact in lbs force
E is jet energy in horsepower-hours per pound mass
P is water supply pressure in pounds per square inch
A is cross-sectional area of the jet in square inches
Q is volumetric water flow in cubic inches per minute
w is web weight in ounces per square yard
z is web width in yards and
s is web speed in yards per minute.

The major difference between prior art hydroentangling processes and the process of the instant invention is the manner in which the web is jetted. Prior art processes impart high impact energies to the web due to such parameters as high pressure or low web speed. Conversely, in the inventive process low impact energy (i.e, low water jet pressure or high web speed) is used to hydroentangle the web fibers and produce a spunlaced fabric. Low impact energy minimizes fiber breakage and the generation of additional fiber particles.

The following non-limiting examples further illustrate the differences in jetting between the inventive process and the prior art processes:

EXAMPLES

Example 1

A spunlaced acrylic/polyester fabric was made with blends of acrylic and polyester fibers in the form of an air-laid staple fiber web. Polyester staple fibers having a denier of 1.35 (1.5 dtex) and a length of 0.85 inch (2.2 cm) were blended with Type 404 Orlor® (an acrylic fiber commercially available from E.I. du Pont de Nemours and Company, Wilmington, Del.) staple fibers having a denier of 1.5 (1.7 dtex) and a length of 0.85 inch (2.2 cm) at 50/50 by weight. Acrilar® acrylic fibers, commercially available from Monsanto Corp., St. Louis, Miss., are also suitable for purposes of the invention. The blended fibers were formed into a 2.0 oz.yd2 (67.8 gm/$m^2$) web by an air-laydown process of the type described in U.S. Pat. No. 3,797,074 (Zafiroglu). Then, in a continuous operation, the web was placed and supported on a mesh screen and passed along at a speed of 31 yds/min (28.2 m/min) and then passed underneath a series of banks of belt washer jets under conditions as shown in Table I. In a continuous operation, the web was wrapped around a drum screen and the back side of the web was passed underneath a series of banks of drum washer jets under conditions as shown in Table II.

TABLE I

| Belt Washer Treatment | | | | |
|---|---|---|---|---|
| Jet # | Orifice Diameter inch (mm) | # of Jets per inch (cm) | Pressure psi | I × E Hp-hr-$lb_f/lb_m$ |
| 1 | 0.005 (0.127) | 40 (15.7) | 500 | 0.22 |
| 2 | 0.005 (0.127) | 40 (15.7) | 1000 | 1.22 |
| 3 | 0.005 (0.127) | 40 (15.7) | 1300 | 2.34 |
| 4 | 0.005 (0.127) | 40 (15.7) | 1500 | 3.35 |
| 5 | 0.005 (0.127) | 40 (15.7) | 1500 | 3.35 |
| 6 | 0.005 (0.127) | 40 (15.7) | 1400 | 2.82 |

Total I × E = 13.30 Hp-hr-$lb_f/lb_m$

TABLE II

| Drum Washer Treatment | | | | |
|---|---|---|---|---|
| Jet # | Orifice Diameter inch (mm) | # of Jets per inch (cm) | Pressure psi | I × E Hp-hr-$lb_f/lb_m$ |
| 1 | 0.005 (0.127) | 40 (15.7) | 500 | 0.22 |
| 2 | 0.005 (0.127) | 40 (15.7) | 1000 | 1.22 |
| 3 | 0.005 (0.127) | 40 (15.7) | 1300 | 2.34 |
| 4 | 0.005 (0.127) | 40 (15.7) | 1500 | 3.35 |
| 5 | 0.005 (0.127) | 40 (15.7) | 1500 | 3.35 |
| 6 | 0.005 (0.127) | 60 (23.6) | 1200 | 2.88 |

Total I × E = 13.36 Hp-hr-$lb_f/lb_m$

The inventive fabric was tested for dry particle generation using a Gelbo Flex Test Apparatus. The inventive fabric was tested for wet particle generation using a biaxial shake test. Both wet and dry particle generation were tested by the test procedure described in IES-RP-CC-004-87-T. The results of the wet and dry particle tests are tabulated below in Table III and are compared to results obtained for a commercial spunlaced 2.0 oz/$yd^2$ (67.8 g/$m^2$) woodpulp/polyester (WP/PET) fabric and a spunlaced 2.0 oz/$yd^2$ (67.8 g/m²) 100% polyester (PET) fabric. Absorbency rates and capacities are also provided for the inventive fabric, the WP/PET fabric and the PET fabric. Both the WP/PET and PET fabrics are currently used as commercial cleanroom wipers.

TABLE III

| Properties | Inventive Fabric | WP/PET Fabric | PET Fabric |
|---|---|---|---|
| Particle counts (≧0.5 microns) | | | |
| Dry | 500 | 43600 | 4550 |
| Wet | 7030 | 9060 | 1590 |
| Absorbency | | | |
| Rate (g/g/sec) | 0.39 | 0.25 | 0 |
| Capacity (%) | 820 | 340 | — |

The fabrics of the invention generate lower particle counts than WP/PET fabrics and exhibit higher absorbency rates and capacities than both the WP/PET and PET fabrics.

Example 2

In this example, the beneficial effects of higher web speeds (i.e., lower impact energy) for passing the web under the water jets in regard to reduced particle generation of the fabric are demonstrated. The same blend of 50/50 by weight fibers as described in Example 1 was formed into a 2.0 oz/yd² (67.8 g/m²) web and it was placed and supported on a fine mesh screen except that the web was forwarded through the water jets at about twice the speed (60 yds/min). (For purposes of the invention, the web speed is preferably maintained at between 20 to 200 yds/min.) Then, in a continuous operation, the web was passed under a series of banks of belt washer jets under conditions shown in Table IV below. In a continuous operation, the web was then wrapped around a drum screen and the back side of the web was passed under a series of banks of drum washer jets under conditions as shown in Table V below.

TABLE IV

Belt Washer Treatment

| Jet # | Orifice Diameter inch (mm) | # of Jets per inch (cm) | Pressure psi | I × E Hp-hr-lb$_f$/lb$_m$ |
|---|---|---|---|---|
| 1 | 0.005 (0.127) | 40 (15.7) | 700 | 0.22 |
| 2 | 0.005 (0.127) | 40 (15.7) | 900 | 0.42 |
| 3 | 0.005 (0.127) | 40 (15.7) | 1400 | 1.26 |
| 4 | 0.007 (0.177) | 20 (7.9) | 1500 | 2.89 |
| 5 | 0.007 (0.177) | 20 (7.9) | 1400 | 2.43 |

Total I × E = 7.22 Hp-hr-lb$_f$/lb$_m$

TABLE V

Drum Washer Treatment

| Jet # | Orifice Diameter inch (mm) | # of Jets per inch (cm) | Pressure psi | I × E Hp-hr-lb$_f$/lb$_m$ |
|---|---|---|---|---|
| 1 | 0.005 (0.127) | 40 (15.7) | 700 | 0.22 |
| 2 | 0.005 (0.127) | 40 (15.7) | 900 | 0.42 |
| 3 | 0.005 (0.127) | 40 (15.7) | 1200 | 0.86 |
| 4 | 0.005 (0.127) | 40 (15.7) | 1500 | 1.50 |
| 5 | 0.005 (0.127) | 40 (15.7) | 0 | 0 |
| 6 | 0.005 (0.127) | 60 (23.6) | 1500 | 2.25 |

Total I × E = 5.25 Hp-hr-lb$_f$/lb$_m$

The inventive fabric of Example 2 was tested for dry particle generation using a Gelbo Flex Test Apparatus. The inventive fabric was also tested for wet particle generation using a biaxial shake test. Both wet and dry particle generation were tested by the test procedure described in IES-RP-CC-004-87-T. The results of the wet and dry particle tests are tabulated below in Table VI and are compared against the results in Example 1 wherein higher I×E values were used.

TABLE VI

Particle Generation vs. I × E

| | Example 1 | Example 2 |
|---|---|---|
| Particle counts (≧0.5 microns) | | |
| Dry | 500 | 696 |
| Wet | 7030 | 2862 |
| I × E (Belt) | 13.30 | 7.22 |
| I × E (Drum) | 13.36 | 5.25 |
| Total I × E | 26.66 | 12.47 |

Table VI shows that a lower total energy-input product (I×E) for both the belt washer jets and the drum washer jets results in a fabric having lower wet particle generation while maintaining low dry particle generation. This result is believed to occur because lower energy input reduces fiber breakage and surface fabrilation which cause particle formation.

Example 3

In this example, the spunlaced fabric of the invention is vacuum dewatered instead of squeezed rolled to further reduce wet particle count. The same blend of fibers as described in Example 1 was formed into a 1.5 oz/yd² (50.9 g/m²) web using the equipment and air-lay process described in Example 1. The web was placed and supported on a mesh screen and forwarded at a speed of 92 yds/min (83.6 m/min). Then, in a continuous operation, the web was passed under a series of banks of belt washer jets and drum washer jets under conditions as shown in Tables IV and V respectively. Fabric A was dewatered with a conventional squeeze roll dewatering device after passing the drum washer jets. Fabric B was dewatered with a vacuum dewatering extractor at 7 inches of mercury vacuum after passing the drum washer jets. The results are summarized in Table VII below. The results show that vacuum dewatering clearly reduces wet particle count significantly.

TABLE VII

| | Fabric A (Squeeze roll) | Fabric B (Vacuum extractor) |
|---|---|---|
| Particle count (≧0.5 microns) | | |
| Dry | 974 | 618 |
| Wet | 4562 | 2750 |

Example 4

In this example, five fabric samples of various fiber blends were treated under the process conditions set forth in Example III of Evans. A 100% acrylic sample (A), a 65/35 acrylic/rayon sample (B), a 65/35 acrylic/-PET sample (C), a 65/35 acrylic/nylon sample (D), and a 65/35 acrylic/anti-static acrylic sample (E) were all prepared and treated under the process conditions set forth in Table VIII below. The results indicate that the total I×E product for Example III of Evans is many magnitudes higher than the I×E products of the inventive process.

TABLE VIII

| | | Fabric | | | | |
|---|---|---|---|---|---|---|
| | | A | B | C | D | E |
| Basis Wt. (oz/sq. yd) | | 2.6 | 2.8 | 2.6 | 2.5 | 2.5 |
| A. | Drum Screen Speed (yd/min) | 5 | 5 | 5 | 5 | 5 |
| | Jet #1 | | | | | |
| | Orifice (in) | 0.005 | → | → | → | → |
| | jet per in | 40 | → | → | → | → |
| | pressure, psi | 500 | → | → | → | → |
| | Jet #2 | | | | | |
| | Orifice (in) | 0.007 | → | → | → | → |
| | jet per in | 20 | → | → | → | → |
| | pressure, psi | 900 | → | → | → | → |
| B. | Flat Screen Speed (yd/min) | 1.3 | 2.0 | 1.3 | 1.0 | 1.6 |
| | Jet #3 | | | | | |
| | Orifice (in) | 0.005 | → | → | → | → |
| | jet per in | 40 | → | → | → | → |
| | pressure, psi | 500 | → | → | → | → |
| | Jet #4 | | | | | |
| | Orifice (in) | 0.007 | → | → | → | → |
| | jet per in | 20 | → | → | → | → |
| | pressure, psi | 1200 | 1200 | 1500 | 1500 | 1500 |
| | Jet #5 | | | | | |
| | Orifice (in) | 0.007 | → | → | → | → |
| | jet per in | 20 | → | → | → | → |
| | pressure, psi | 2000 | 2000 | 1500 | 1500 | 2000 |
| | Jet #6 | | | | | |
| | Orifice (in) | 0.007 | → | → | → | → |
| | jet per in | 20 | → | → | → | → |
| | pressure, psi | 2000 | 2000 | 1500 | 1500 | 2000 |
| | The total I × E products for these samples are as follows: | | | | | |
| I × E: | Drum (jets 1-2) | 9.7 | 9.0 | 9.7 | 10.1 | 10.1 |
| | Belt (jets 3-6) | 560.3 | 337.6 | 360.7 | 488.3 | 515.8 |
| | Total (Hp-hr-$lb_f/lb_m$) | 570.3 | 346.6 | 370.4 | 498.4 | 525.9 |

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

We claim:

1. A process for making spunlaced acrylic/polyester fabrics comprising the steps of:

(a) supporting a lightweight web of fibers on a mesh screen wherein the fibers comprise a blend of 10–90 wt.% acrylic fibers and 10–90 wt.% polyester fibers; and (b) passing the supported web underneath low energy water jets operating at a total impact energy no greater than 30 Hp-hr-$lb_f/lb_m$ to entangle the acrylic and polyester fibers and form a spunlaced fabric.

2. The process of claim 1 further comprising the step of vacuum dewatering the spunlaced fabrics to remove water and suspended particles.

3. The process of claim 1 wherein the web is passed underneath the water jets at a speed of between 20 to 200 yds/min.

4. A process for making spunlaced acrylic/polyester fabrics comprising the steps of:

(a) supporting a lightweight web of fibers on a mesh screen wherein the fibers comprise a blend of 30–90 wt.% acrylic fibers and 10–70 wt.% polyester fibers;

(b) passing the supported web underneath low energy water jets operating at a total impact energy between 5 and 28 Hp-hr-$lb_f$,$lb_m$ to entangle the acrylic and polyester fibers; and (c) vacuum dewatering the spunlaced fabric to remove water and suspended particles.

5. The process of claim 4 wherein the web is passed underneath the water jets at a speed of between 20 to 200 yds/min.

6. A spunlaced acrylic/polyester fabric produced by the process of any of claims 1–5.

7. A spunlaced acrylic/polyester fabric having a dry-particle count no greater than 5000, a wet particle count no greater than 9500, an absorbency rate of at least 0.1 gm/gm/sec and an absorbency capacity of at least 600%.

8. The spunlaced acrylic/polyester fabric of claim 7 wherein the dry particle count is no greater than 1000, the wet particle count is no greater than 8000, the absorbency rate is at least 0.25 gm/gm/sec and the absorbency capacity is at least 700%.

9. The spunlaced fabric of claim 7 wherein the fabric comprises a cleanroom wiper or coverstock for sanitary napkins and diapers.

* * * * *